US008534825B2

(12) United States Patent
Leighton et al.

(10) Patent No.: US 8,534,825 B2
(45) Date of Patent: Sep. 17, 2013

(54) RADIANT HEATER FOR PRINT MEDIA

(75) Inventors: Roger G. Leighton, Hilton, NY (US); Michael F. Leo, Penfield, NY (US); Nicholas P. Kladias, Fresh Meadows, NY (US); James Edward Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 406 days.

(21) Appl. No.: 13/025,948

(22) Filed: Feb. 11, 2011

(65) Prior Publication Data

US 2012/0206527 A1 Aug. 16, 2012

(51) Int. Cl.
*B41J 2/01* (2006.01)

(52) U.S. Cl.
USPC ..... 347/102

(58) Field of Classification Search
CPC ..... B41J 11/002
USPC ..... 347/16, 101, 102, 104; 219/390, 219/405
See application file for complete search history.

(56) References Cited

U.S. PATENT DOCUMENTS

| | | | |
|---|---|---|---|
| 4,634,837 | A | 1/1987 | Ito et al. |
| 4,697,165 | A | 9/1987 | Ishiguro et al. |
| 4,914,276 | A | 4/1990 | Blair |
| 5,022,167 | A | 6/1991 | Nakamura |
| 5,046,944 | A | 9/1991 | Smith |
| 5,634,402 | A | 6/1997 | Rudd et al. |
| 5,856,652 | A | 1/1999 | Mayuzumi |
| 5,916,467 | A | 6/1999 | Shimada |
| 6,132,038 | A | 10/2000 | Szlucha |
| 6,186,612 | B1 | 2/2001 | Maeda et al. |
| 6,244,700 | B1 | 6/2001 | Kimura et al. |
| 6,392,197 | B2 | 5/2002 | Natsuhara et al. |
| 6,407,366 | B2 | 6/2002 | Yoshimura |
| 6,671,489 | B2 | 12/2003 | Natsuhara et al. |
| 6,950,616 | B2 | 9/2005 | Saito et al. |
| 7,137,694 | B2 | 11/2006 | Ferran et al. |
| 7,677,715 | B2 | 3/2010 | Uji et al. |
| 7,702,249 | B2 | 4/2010 | Nishida |
| 7,793,117 | B2 | 9/2010 | Smith |
| 7,805,102 | B2 | 9/2010 | Kato |
| 7,832,852 | B2 | 11/2010 | Leighton et al. |
| 2007/0047990 | A1 | 3/2007 | Lemaster et al. |
| 2009/0021550 | A1 | 1/2009 | Leighton et al. |

FOREIGN PATENT DOCUMENTS

| | | | |
|---|---|---|---|
| EP | 0798119 | A1 | 1/1997 |

*Primary Examiner* — An Do
(74) *Attorney, Agent, or Firm* — Maginot, Moore & Beck, LLP

(57) ABSTRACT

A heater panel is configured to heat a print medium in a printer. The heater panel includes electrical conductors that form a plurality of heating zones to emit radiant energy toward the print medium. Heating zones that correspond to edges of the print medium emit radiant energy with a greater power density than heating zones that correspond to central portions of the print medium. The heater panel has a plurality of angled positions to vary the view factor for high gain control.

20 Claims, 7 Drawing Sheets

RADIANT HEATER FOR PRINT MEDIA

TECHNICAL FIELD

This disclosure relates generally to imaging devices that print images on media, and, more particularly, to heaters used to condition the media during printing operations.

BACKGROUND

In general, inkjet printing machines or printers include at least one printhead unit that ejects drops of liquid ink onto recording media or an imaging member for later transfer to media. Different types of ink may be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets quickly solidify.

The media used in both direct and offset printers may be in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In offset sheet printers, a media sheet travels along the feed path to a nip formed between the rotating imaging member and a transfix roller. The pressure and heat in the nip transfer the ink image from the imaging member to the media. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

Regardless of the type of media used, media heating helps transfer the ink more efficiently to the recording media. In web-fed printers, media heaters typically comprise one or more radiant heaters that are positioned along the media pathway. These heaters raise the temperature of the moving web. Adjusting the power supplied to the heaters controls the output of the radiant heaters. The printing system typically includes a thermal sensor positioned adjacent the media pathway to detect the temperature of the moving web and provide the detected temperatures to a controller. The controller may compare the detected temperatures to temperature thresholds to adjust the power provided to the heaters to maintain the temperature of the media web in appropriate temperature ranges at different locations along the feed path.

Existing radiant heaters used in printers generate heat using high-temperature lamps with one typical lamp having a filament configured to heat to 1200° C. with a surface temperature of 800° C. In operation, these lamps emit radiant energy with a range of wavelengths including portions of the visible spectrum at approximately 0.7 μm through portions of the infrared spectrum at 1.5 μm to 2.5 μm. Some of these lamps are relatively energy inefficient, and require separate reflector elements to redirect radiant energy toward the print media to bring the print media to an appropriate temperature. The energy consumption of the radiant heaters is one factor affecting the operating cost of the printing device. Thus, improvements to radiant heaters that can heat print media while reducing the power usage of printing devices are desirable.

SUMMARY

In at least one embodiment, a radiant heater for heating a print medium in a printer has been developed. The radiant heater includes a ceramic foam substrate having a first edge and a second edge, an electrical conductor bonded to the ceramic foam substrate, and a cover layer bonded to the electrical conductor. The electrical conductor has a first electrical resistance in a first heating zone formed proximate the first edge and the second edge of the ceramic foam substrate and a second electrical resistance in a second heating zone between the first edge and the second edge to enable radiant energy at a first power density in the first heating zone and radiant energy at a second power density in the second heating zone to be emitted by the cover layer, the first power density being greater than the second power density.

In at least one other embodiment, a solid ink printer has been developed. The printer includes a media handling system configured to transport a continuous media web along a media pathway through the imaging device, the media pathway having a first edge and a second edge, a solid ink printing system positioned along the media pathway, a web heating system positioned along the media pathway, and a web heating controller. The solid ink printing system is configured to print images on the continuous media web moving along the media pathway. The web heating system is positioned along the media pathway at a location that enables the web heating system to heat the continuous media web after the solid ink printing system has printed an image on the continuous media web, the web heating system being configured to heat the continuous media web to a web heating temperature. The web heating system includes at least one radiant heating unit positioned adjacent the media pathway a pair of radiant heaters configured within the housing to emit radiant energy in accordance with a variable radiant power signal. The at least one radiant heating unit includes a housing adjacent to the media pathway. The housing has an opening proximate the media pathway. The pair of radiant heaters are configured to be positioned selectively in the housing to any one of a plurality of positions between and including a fully open position in which the pair of radiant heaters are positioned side by side in the opening of the housing to direct radiant energy towards the media pathway and a retracted position in which the pair of radiant heaters are positioned inside the housing and facing each other, a view factor of the pair of radiant heaters with respect to the media pathway being different for each position in the plurality of positions. Each radiant heater includes an electrical conductor bonded to a substrate, the electrical conductor forming a plurality of heating zones, a panel driver operatively connected to the pair of radiant heaters to enable the pair of radiant heaters to be positioned in at least one of the plurality of positions in response to a variable view factor signal, and at least one temperature sensor configured to detect a temperature of the continuous media web moving along the media pathway and to generate a temperature signal indicative of the detected temperature of the continuous media web. The at least one heating zone is configured to emit radiant energy at a first power density towards the first edge and the second edge of the media pathway, and at least one other heating zone configured to emit radiant energy at a second power density towards a central portion of the media pathway. The web heating controller is operatively connected to the panel driver and configured to generate a selected radiant power signal and the variable view factor signal for operation of the panel driver to position at least one radiant heater to heat the continuous media web to the web heating temperature. The web heating controller is configured to generate at least one of the radiant power signal signals and the variable view factor signals in accordance with the temperature signal generated by the at least one temperature sensor.

In at least another embodiment, a radiant heater panel has been developed. The radiant heater panel includes an electrical conductor having a first electrical resistance, and a cover layer configured to emit heat generated by an electrical current flowing through the electrical conductor. The emitted heat has a wavelength in a predetermined range.

DETAILED DESCRIPTION

Figure 1:
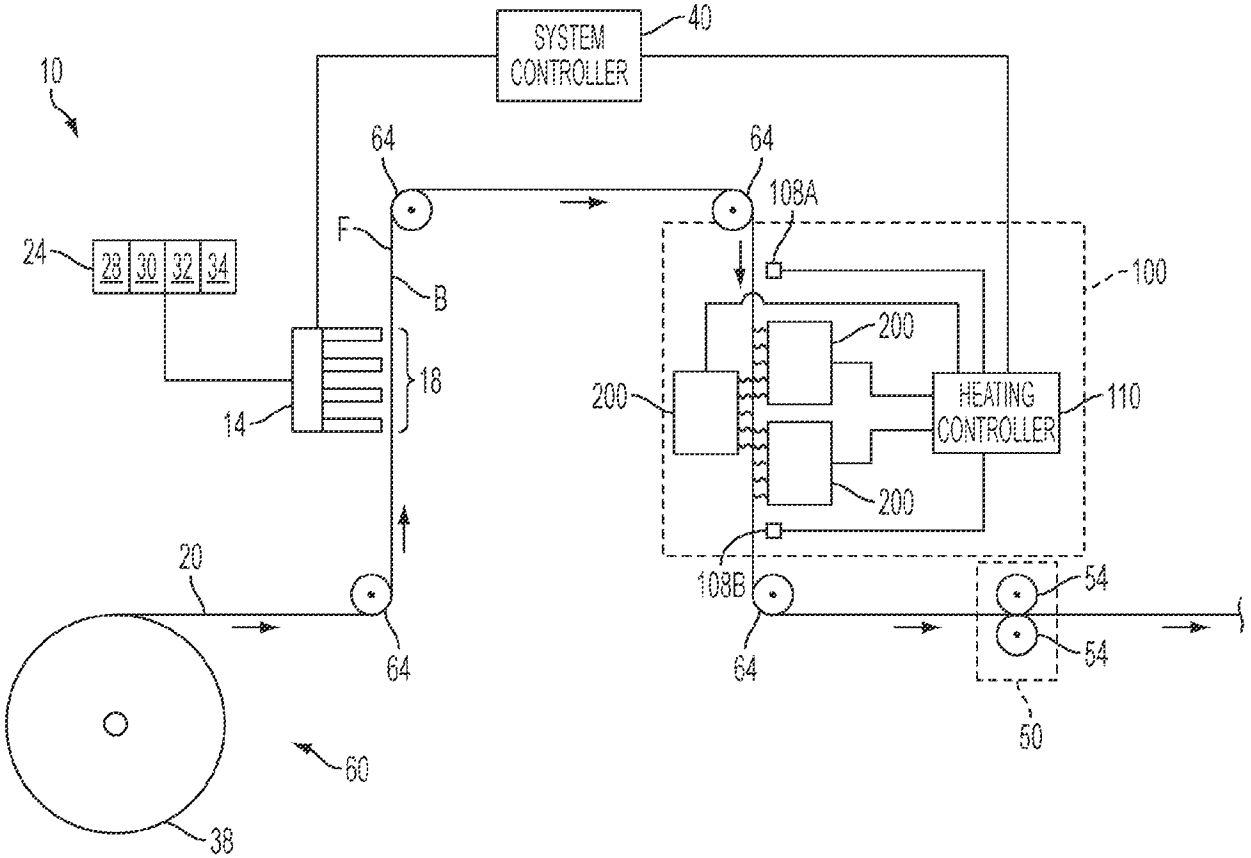
FIG. 1 is a block diagram of a phase change imaging device for printing onto a continuous media web.

For a general understanding of the environment for the system and method disclosed herein as well as the details for the system and method, the drawings are referenced throughout this document. In the drawings, like reference numerals designate like elements. As used herein the term "printer" refers to any device that is configured to eject a marking agent upon an image receiving member and include photocopiers, facsimile machines, multifunction devices, as well as direct and indirect inkjet printers, laser printers, thermal printers, LED printers, and any imaging device that is configured to form images on a print medium. As used herein, the term "process" direction refers to a direction of travel of an image receiving member, such as an imaging drum or print medium, and the term "cross-process' direction is a direction that is perpendicular to the process direction along the surface of the image receiving member.

The term "artwork" refers to the size, shape, pattern, and arrangement of one or more electrical conductors formed in a heater panel. The electrical conductor generates heat in response to an electrical current flowing through the conductor. The configuration of the artwork may vary in different locations through the heater panel to change the power density of radiant energy emitted from the heater panel at each location. The term "power density" refers to an amount of radiant power emitted from a given area of a heater. For example, a 1 $cm^2$ section of a heater that emits 10 Watts of power has a power density of 10 watts/$cm^2$. As used herein, a "view factor" is defined as the proportion of the radiant energy emitted by a radiant heater that reaches a print medium in relation to the total amount of radiant energy emitted by the radiant heater.

As shown in FIG. 1, the phase change ink printing system includes a web supply and handling system 60, a printhead assembly 14, a fixing assembly 50 and a web heating system 100. The web supply and handling system 60 may include one or more media supply rolls 38 for supplying a media web 20 to the imaging device. The supply and handling system is configured to feed the media web in a known manner along a media pathway in the imaging device through the print zone 18, and past the web heating system 100, and fixing assembly 50. To this end, the supply and handling system may include any suitable device 64, such as drive rollers, idler rollers, tensioning bars, etc., for moving the media web through the imaging device. The system may include a take-up roll (not shown) for receiving the media web 20 after printing operations have been performed. Alternatively, the media web 20 may be fed to a cutting device (not shown) as is known in the art for cutting the media web into discrete sheets.

The printhead assembly 14 is appropriately supported to eject drops of ink directly onto the media web 20 as the web moves through the print zone 18. In alternative embodiments, the printhead assembly 14 may be configured to emit drops onto an intermediate transfer member (not shown), such as a drum or belt, for subsequent transfer to the media web. The printhead assembly 14 may be incorporated into either a carriage type printer, a partial width array type printer, or a page-width type printer, and may include one or more printheads. As illustrated, the printhead assembly includes four page-width printheads for printing full color images comprised of the colors cyan, magenta, yellow, and black.

The solid ink supply 24 supplies ink to the printhead assembly. Since the phase change printer 10 is a multicolor device, the ink supply 24 includes four sources 28, 30, 32, 34, representing four different colors CYMK (cyan, yellow, magenta, black) of phase change ink solid ink. Alternative embodiments of the printing system 10 may be configured to print ink having a single color, or to print various ink colors other than the CYMK colors, including spot colors and clear inks. The phase change ink system 24 also includes a solid phase change ink melting and control assembly or apparatus (not shown) for melting or phase changing the solid form of the phase change ink into a liquid form, and then supplying the liquid ink to the printhead assembly 14.

Once the drops of ejected ink form an image on the moving web, a fixing assembly 50 fixes the ink image to the web as the web passes through the assembly 50. In the embodiment of FIG. 1, the fixing assembly 50 comprises at least one pair of fixing rollers 54 that are positioned in relation to each other to form a nip through which the media web is fed. The pressure in the nip presses the ink drops into the media web and spreads the ink on the web. Although the fixing assembly 50 is depicted as a pair of fixing rollers, the fixing assembly may be any suitable type of device or apparatus, as is known in the art, which is capable of fixing the image to the web.

A controller 40 operates and controls the various subsystems, components and functions of the printer 10. The controller 40 may be implemented as hardware, software, firmware or any combination thereof. In one embodiment, the controller 40 comprises a self-contained, microcomputer having a central processor unit (not shown) and electronic storage (not shown). The electronic storage may store data necessary for the controller such as, for example, the image data, component control protocols, etc. The electronic storage may be a non-volatile memory such as a read only memory (ROM) or a programmable non-volatile memory such as an EEPROM or flash memory. Of course, the electronic storage may be incorporated into the inkjet printer, or may be externally located. The controller 100 is configured to orchestrate the production of printed or rendered images in accordance with image data received from the image data source (not shown). The image data source may be any one of a number of different sources, such as a scanner, a digital copier, a facsimile device, etc. Pixel placement control is exercised relative to the media web 20 in accordance with the print data, thus, forming desired images per the print data as the media web is moved through the print zone.

The web heating system 100 comprises one or more radiant heating units 200 that direct radiant energy onto the web 20. The media web absorbs the radiant energy emitted from the units 200 at a color temperature suitable for heating the chosen media type, including a 3.0-4.0 um range for paper. Radiant heating units 200 may be positioned anywhere along the media pathway for emitting radiant energy toward the media web. In the embodiment of FIG. 1, radiant heating units 200 are positioned downstream from the printhead assembly 14 in order to heat the media web 20 prior to fixing the image to the web at the fixing assembly 50. Mid-heating is a term that describes this type of heating. In other embodiments, radiant heating units 200 may also be positioned to heat the media web prior to reaching the print zone (preheating) and/or downstream from the printhead assembly (post-heating). Any suitable number of radiant heating units may be employed. The web heating system 100 in the depicted embodiment includes three radiant heating units 200 positioned upstream from the printhead assembly that preheat the media web prior to printing and two radiant heating units successively positioned thereafter that heat a front side F of the media web 20. The web heating system 100 also includes another radiant heating unit that is positioned to heat the backside B of the media web.

In operation, web heating system 100 may heat the media web to any suitable temperature depending upon a number of factors including web speed, web type, ink type, position along the media pathway, etc. For example, when heating the media web, the web heating system may be configured to heat the media web and ink layers to approximately 65 to 70 degrees C. prior to fixing ink images to the web. The web heating system may include one or more noncontact IR temperature sensors 108 as known in the art for measuring the temperature of the moving web 20 at one or more locations associated with the web. Temperature sensors 108 may be non-contact type sensors, such as thermopile or similar IR sensors. In one embodiment, a temperature sensor 108A that is provided along the media pathway upstream from the radiant heating units 200 of the web heating system detects the temperature of the web prior to the web passing the radiant heating units. Another temperature sensor 108B may also be provided along the media pathway downstream from the radiant heating units 200 to detect the temperature of the web after the heating units heat the web. Each of the temperature sensors 108A and 108B may measure the temperature of the media web at various positions in the cross-process direction. These temperature measurements enable the heating controller 110 to identify whether portions of the web are inside or outside of the operational temperature range. In any case, the temperature sensors 108 are operable to relay signals indicative of the one or more measured temperatures to the web heating controller 110. Knowing temperatures before and after the heating unit enables the controller to adjust the view factor angle as the web passes the heating units 200 to control the exit paper temperature accurately.

Once the heater units have reached temperatures that are sufficient to heat print media, a relatively significant delay may occur between an adjustment of electrical power supplied to the panels and a corresponding change in the radiant power output of the panels. The web heating system 100 of the present disclosure includes a dual gain control system that regulates the radiant output of the panels by adjusting the delivery of electrical power to the panels (low gain control). The system 100 also controls the amount of radiant energy that reaches the media web from the panels by varying the view factor of the panels relative to the media web (high gain control). As described below, the view factor of the radiant panels to the web may be varied by adjusting the distance, angle and/or orientation of the panels of a heating unit with respect to the media web. View factor adjustments, thus, involve physical movement of the panels with respect to the media web. Therefore, depending on the method of moving the panels, view factor adjustments may be performed relatively quickly to facilitate rapid adjustments of the amount of radiant energy that reaches the media web.

Figure 2:
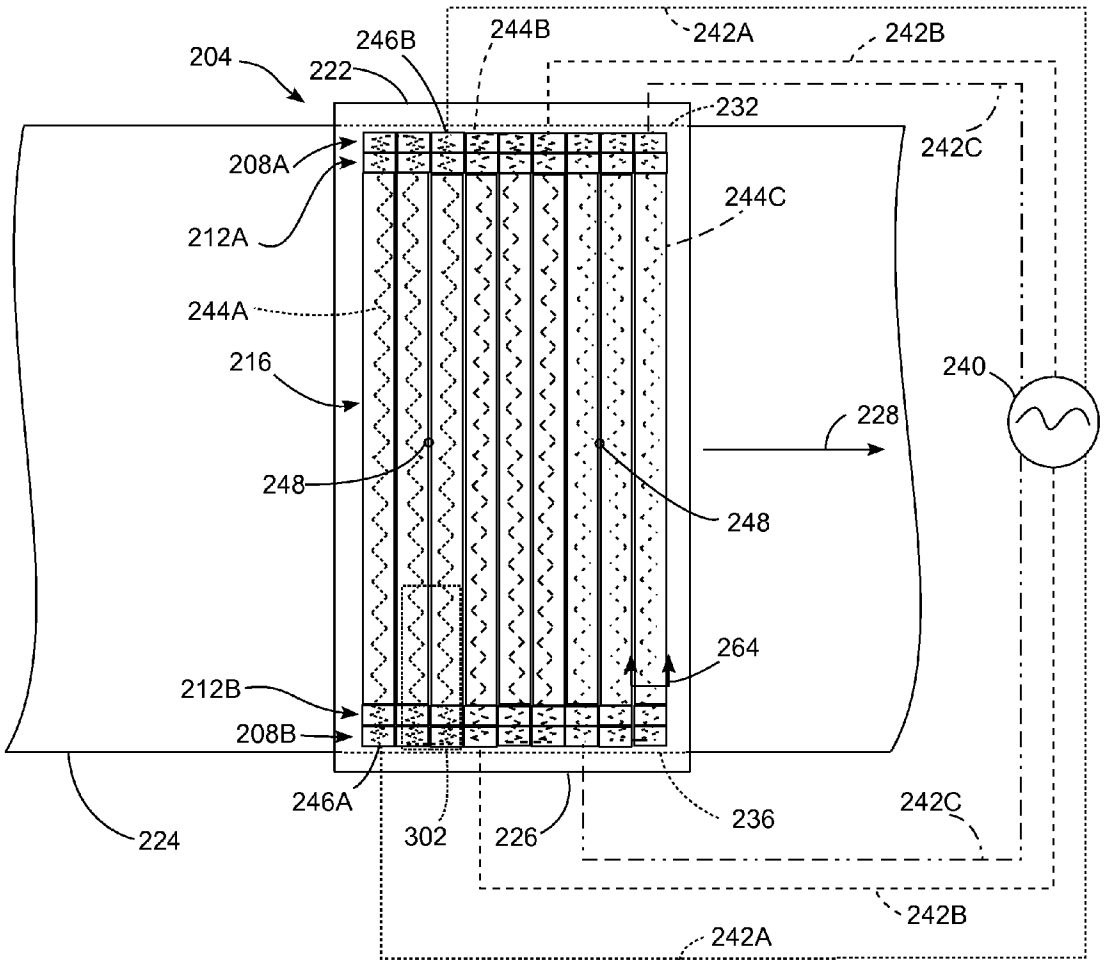
FIG. 2 is a front view of a radiant heater panel.

Another development that facilitates the delivery of heat to a web is the construction of a heater panel that generates heat having a particular wavelength. FIG. 2 depicts a front view of such a radiant heater 204 that is suitable for use in a radiant heater unit. FIG. 2 depicts radiant heater 204 that is configured to radiate heat onto a media web 224. The example embodiment of radiant heater 204 is electrically connected to a three-phase electrical power source 240. The radiant heater 204 includes three different electrical conductors, shown schematically as conductors 244A-244C, that generate heat in response to electrical current from one of the phases in the three phase power source 240 flowing through each conductor. The conductors 244A-244C may also be referred to as heating elements. Each of the conductors 244A-244C is electrically connected to one phase of the three-phase power supply 240 through electrical leads 242A-242C, respectively. Using conductor 244A as an example, the conductor is depicted as a line that undulates across a width of the radiant heater 204 between connectors 246A and 246B that couple the conductor 244A to the electrical leads 242A. The conductor 244A traverses the width of the heater 204 three times between the connectors 246A and 246B. Conductors 244B and 244C are configured in a substantially identical fashion to their respective connectors in radiant heater 204.

Figure 3:
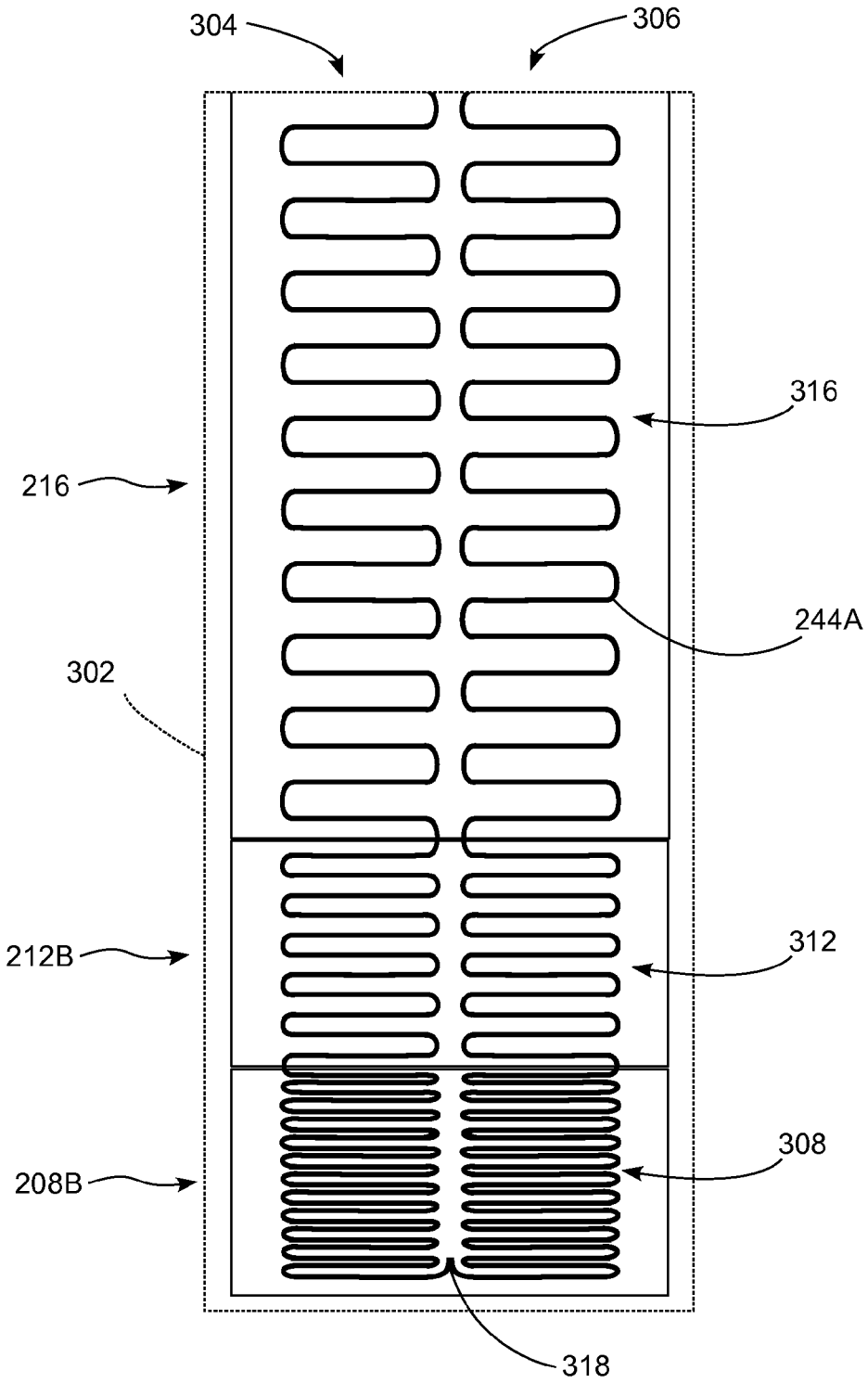
FIG. 3 is a plan view illustrating heater element artwork used in the radiant heater panel of FIG. 2.

Referring to FIG. 2 and FIG. 3, radiant heater 204 is configured to vary the heat generated by the heater in different heating zones arranged in the heater 204. In the example of FIG. 2, each of the electrical conductors 244A-244C passes through heating zones 208A, 208B, 212A, 212B, and 216. The electrical resistance of each of the electrical conductors 244A-244C is determined, at least in part, by the number of bends in the conductor in each heating zone. The electrical power source 240 applies an electrical current through each of the conductors 244A-244C to enable the conductors to emit radiant energy at different predetermined power densities in the different heating zones.

The heating zones 208A, 208B, 212A, 212B, and 216 are arranged as seen in FIG. 2 to enable the heater 204 to heat the media web 224 in a more uniform manner. When heated by conventional media heaters, the areas of the media web 224 near the outside edges 232 and 236 to cool more quickly than areas near the center of the media web 224. Large differences in web temperature near the edges of the web may result in gloss image changes near the edge of the media, which may result in negative effects on image quality. To address the uneven web temperature, the shape and configuration of the conductors 244A-244C are varied in the different heating zones 208A, 208B, 212A, 212B, and 216 to enable the radiant heater to radiate heat at a selected power density in each heating zone. The number of bends in the electrical conductor provided by the artwork configuration of the electrical conductor in each heating zone produces different electrical resistances in the conductor at the different zones in the heater panel. Specifically, the power densities in the outer zones 208A and 208B are higher than the power densities produced in zones 212A and 212B, which are greater than the power density produced in zone 216. Consequently, the heater watt density (flux) is increased near the edges and varies the amount of heat generated in different sections of the heater to address losses that may occur at different areas of the material being heated.

In FIG. 2, the power densities of the heating zones 208A-208B and 212A-212B enable these zones to deliver an amount of radiant energy to portions of the print medium near either edge of the print medium in the cross-process direction sufficient to heat those portions of the media to a temperature within an operating temperature range. The portions of the continuous media 224 web near edges 232 and 236 radiate heat more quickly than the central portions of the media web passing over heater zone 216, and therefore tend to have lower temperatures than the central portions of the media web. The power density of radiant energy delivered to the edges of the print medium 224 enables the temperature over the width of the print medium 224 to be more uniform, with one embodiment maintaining a temperature range of 65° C. to 70° C. across the width of the print medium 224. The higher power density also reduces the effects of convection buoyancy losses and view factor losses at the edges of the print medium.

As described above, the power density of heat emitted by the conductor in each heating zone is determined by the artwork of the electrically conductive heating element in each heating zone. FIG. 2 includes an area 302 around conductor 244A that is depicted in more detail in FIG. 3. As described below, the radiant heater 204 is formed from a plurality of layers, and FIG. 3 depicts only the configuration of the conductor 244A through heating zones 208B, 212B and 216 for clarity.

In FIG. 3, conductor 244A is arranged in a sinusoidal pattern extending through the heating zones 208B, 212B, and 216. The pattern in the conductor 244A presents minor images 304 and 306 of the conductor that are electrically connected at juncture 318. Section 308 of the conductor 244A has the densest arrangement of sinusoidal traces in the heating zone 208B. The bends in this dense arrangement of the conductor 244A increases the electrical resistance of the conductor in this area, which enables the conductor section 308 to emit a larger portion of heat per unit area than the other heating zones in which the conductor has fewer turns and/or narrower traces.

The artwork of the conductor 244A in the heating zone 212B is arranged with sinusoidal traces having a lower density, and a correspondingly lower power density in the heating zone 212B. In the configuration of FIG. 3, the conductor section 308 has a higher electrical resistance than conductor section 312. Heating zones 208A and 212A are configured in a substantially identical manner to heating zones 208B and 212B, respectively.

Heating zone 216 includes conductor section 316, which has the lowest relative density of sinusoidal traces, and the corresponding lowest power density. Conductor section 316 also has a lower electrical resistance per unit of length than either conductor section 308 or 312, but a greater overall electrical resistance because the conductor length is longer in this section. The reader should note that while heating zone 216 has the lowest power density of the heating zones depicted in FIG. 3, the total level of radiant power (watts) that heating zone 216 emits may be larger than heating zones 208B and 212B due to the larger size of the heating zone 216.

The arrangement of conductor 244A seen in FIG. 3 is illustrative of one configuration of an electrical conductor in the radiant heater 204, but other configurations are used in other embodiments. For example, in other embodiments, the conductor is arranged in a variety of different repeating patterns through each heating zone, including squared, saw-toothed, and crossing patterns. Any arrangement of the conductor that generates heat with an appropriate power density may be used. Additionally, while conductor 244A is arranged differently in three distinct heating zones in FIG. 3, other embodiments have more or fewer heating zones. In another embodiment, the conductor 244A is arranged with a continuously varying artwork pattern that generates a correspondingly continuous power density gradient across the width of the radiant heater.

In one operational configuration, three-phase power source 240 supplies a one phase of a three-phase 480V electrical signal to each of the conductors 244A-244C. The heating zones 208A and 208B have a combined surface area of approximately 29.5 $cm^2$, and the segments of the electrical conductors 244A-244C in heating zones 208A and 208B are configured to have an electrical resistance of 9.2Ω. Heating zones 212A and 212B have a combined surface area of approximately 32.6 $cm^2$ with the segments of the electrical conductors 244A-244C in those zones having a resistance of 8.5Ω. The central heating zone 216 has a surface area of 403.9 $cm^2$ with the segments of the electrical conductors 244A-244C in those zones having a resistance of 84Ω. Since each of the conductors 244A-244C forms a single series circuit with the power source 240, heating zones 208A-208B emit a total of 142.2 watts of radiant power, heating zones 212A-212B emit a total of 131.8 watts of radiant power, and heating zone 216 emits a total of 1297.7 watts of radiant power. Consequently, heating zones 208A-208B emit radiant energy with a power density of 4.8 watts/$cm^2$, heating zones 212A-212B have a power density of 4.0 watts/$cm^2$, and heating zone 216 has a power density of 3.2 watts/$cm^2$. Thus, in this embodiment, heating zone 216 has the highest total radiant power output, while heating zones 208A-208B that direct radiant energy proximate to the edges of a print media have the highest power density.

Figure 4:
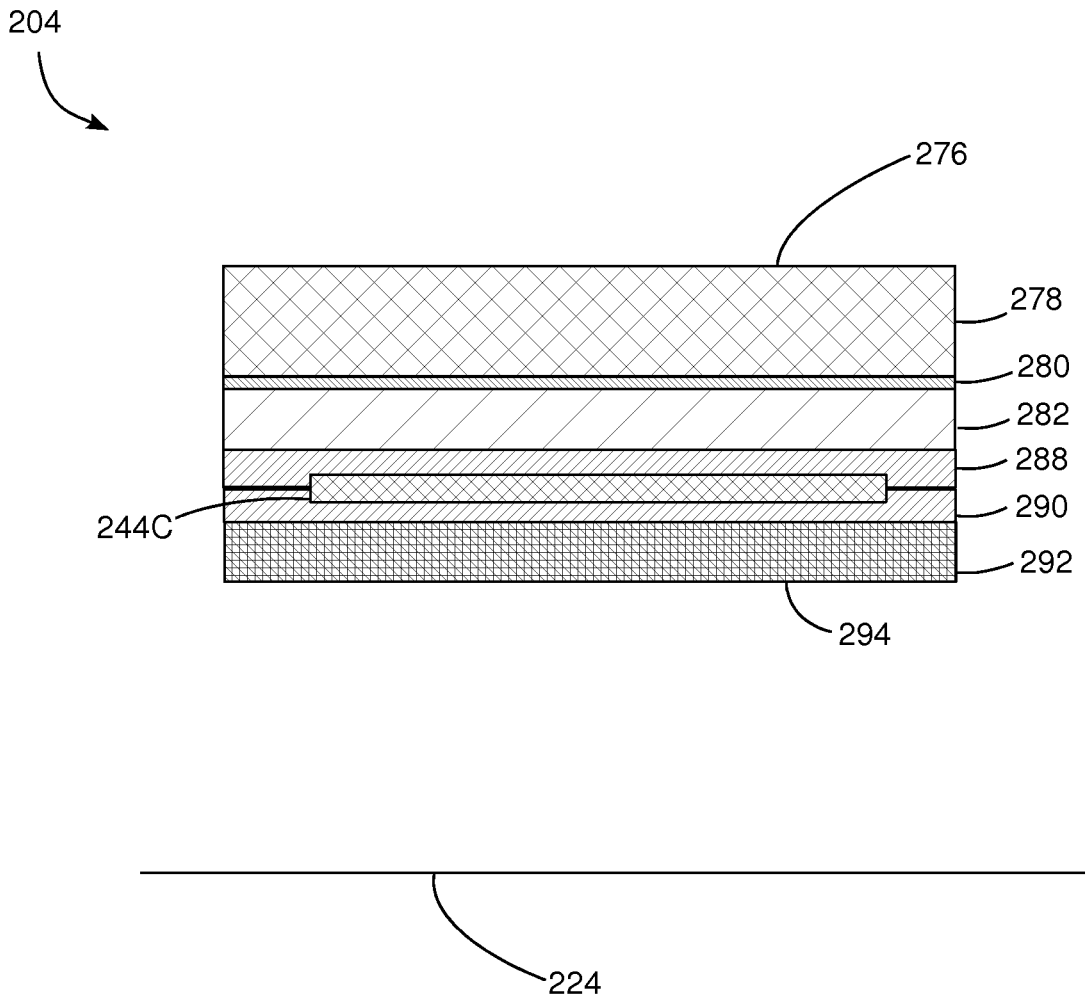
FIG. 4 is a cross-sectional view of a portion of the heater panel of FIG. 2.

The radiant heater 204 in FIG. 2 is formed from multiple layers of material that are formed into a panel. FIG. 4 depicts a cross-sectional view of a portion of the radiant heater panel 204 taken along lines 264 in FIG. 2. The radiant heater 204 includes a mineral wool backing 278, aluminum reflector member 280, ceramic support substrate 282, the electrically conductive heating element 244C, and a fiberglass cover layer 292. A first layer of epoxy 288 bonds the ceramic foam substrate 282 to the heating element 244C, and a second layer of epoxy 290 bonds the fiberglass cover layer 292 about the heating element 244C. As seen in FIG. 4, the epoxy layers 288 and 290 bond to each other and fill in gaps formed around the heating element 244C. When an electrical current is applied to the heating element 244C, the heating element heats the fiberglass cover layer 292 and the radiant heater 204 radiates heat toward media web 224.

Support substrate 282 is embodied here as a ceramic foam panel. Ceramic foam is a porous material with numerous air pockets formed through the ceramic foam to form an efficient thermal insulator. The air in the ceramic foam and the foam itself both have low specific heat and low thermal conductivity. In the embodiment of FIG. 4, an aluminum heat reflector 280 is positioned next to the ceramic foam layer 282 to reflect heat generated in the radiant heater 204 toward the heater element 244C, fiberglass cover layer 282, and media web 224. The mineral wool layer 278 is a fibrous material that serves as a thermal insulator positioned next to the aluminum reflector 280. In combination, the reflector plate 280, ceramic foam layer 282 and mineral wool layer 278 insulate one side of the heating element 244C to reduce the amount of heat that radiates away from the media web 224. In the example embodiment of FIG. 4, the top surface 276 of the mineral wool layer 278 is approximately 400° C. cooler than the bottom surface 294 of the fiberglass cover layer 292 when the radiant panel 204 heats to an operational temperature. The ceramic foam substrate 282, aluminum reflector 280, and mineral wool 276 are illustrative of one configuration for containing heat within the panel 204. Alternative embodiments include different materials and insulator configurations that are suitable for use in the operating temperature range of the radiant heater.

The heating element 244C generates heat in the radiant heater 204 when an electric current passes through the heating element. Epoxy layer 288 bonds the heating element 244C to the substrate layer 282. In the example embodiment of FIG. 4, the heating element 244C is formed from a metallic alloy that is commercially available under the Inconel® brand name. Other materials suitable for use as electrically conductive heating elements may be used in alternative radiant heater configurations. As described above, the shape and configuration artwork of the heating element 244C changes between different heating zones in the radiant heater 204. In some embodiments, the thickness of the heating element 244C also varies to adjust the heat output of the heating element in different heating zones within the radiant heater panel 204.

A fiberglass cover layer 292 is bonded to the heater element 244C and substrate layer 282 by epoxy later 290. This fiberglass layer 292 absorbs and radiates the heat generated by the conductors of the heater panel. In one embodiment, the epoxy later 290 permeates a porous fiberglass material to form a fiberglass-epoxy matrix for the fiberglass cover layer 292. A fiberglass mesh such as a fiberglass scrim cloth is one form of fiberglass that forms a matrix with the epoxy. The fiberglass cover layer 292 emits heat through a bottom surface 294 with wavelengths of greater than 3.0 μm. In the embodiment of FIG. 4, the majority of the generated heat has a wavelength in the 3.0 μm to 4.0 μm range that corresponds to the infrared portion of the electromagnetic spectrum. Various materials commonly used in print media, such as paper, water, and wax, efficiently absorb wavelengths of heat in the infrared range of the electromagnetic spectrum. In other embodiments, the epoxy layer 290 is formed from a dark or black colored epoxy that permeates the fiberglass cover layer 292 and gives the fiberglass cover layer 292 a dark or black color. The dark or black color promotes emission of radiant heat energy with the selected wavelengths.

The radiant heater 204 emits radiant energy concentrated at wavelengths that heat print media efficiently and selectively concentrate the radiant energy on portions of the print media that lose heat more quickly. Thus, radiant heater 204 heats print media to an operational temperature range more efficiently than previously known heaters, and the radiant heater 204 operates with a lower electrical energy input than previously known heaters since the print medium 224 absorbs a portion of the radiant energy emitted from radiant heater 204 that is sufficient to heat the medium to an operating temperature.

With reference to FIG. 2, thermocouples 248 are bonded between one of the electrical conductors 244A, 244C and the cover layer 292 to generate electrical signals that correspond to the temperature of the heater 204. In operation, a heater controller monitors the thermocouples 248 to identify the temperature and corresponding radiant power level of the heater 204. The heater controller increases or decreases the voltage level applied to the heater 204 to increase or decrease, respectively, the total radiant power output of the heater 204. The variable voltage applied to the panels is a variable radiant power signal, and the heater controller selects different variable voltage levels to apply low gain control to the heater panel. The thermocouples 248 are used in conjunction with various media temperature sensors, such sensors 108A and 108B shown in FIG. 1, to enable this feedback control of the heater.

The configuration of the radiant heater 204 depicted in FIG. 2 is merely exemplary, and alternative heaters may employ greater or fewer heating zones with larger or smaller surface areas, power densities, and total radiant power output levels. Various alternative embodiments of radiant heater 204 include one or more heating zones energized with different electrical currents to produce selected levels of radiant power. Other alternative embodiments form a continuous power density gradient across the radiant heater instead of providing discrete heating zones. While radiant heater 204 is depicted using three electrical conductors that are connected to a three-phase electrical power source, alternative embodiments generate radiant energy using one or more conductors in response to receiving both alternating current (AC) having different phases and direct current (DC) electrical signals.

Figure 5:
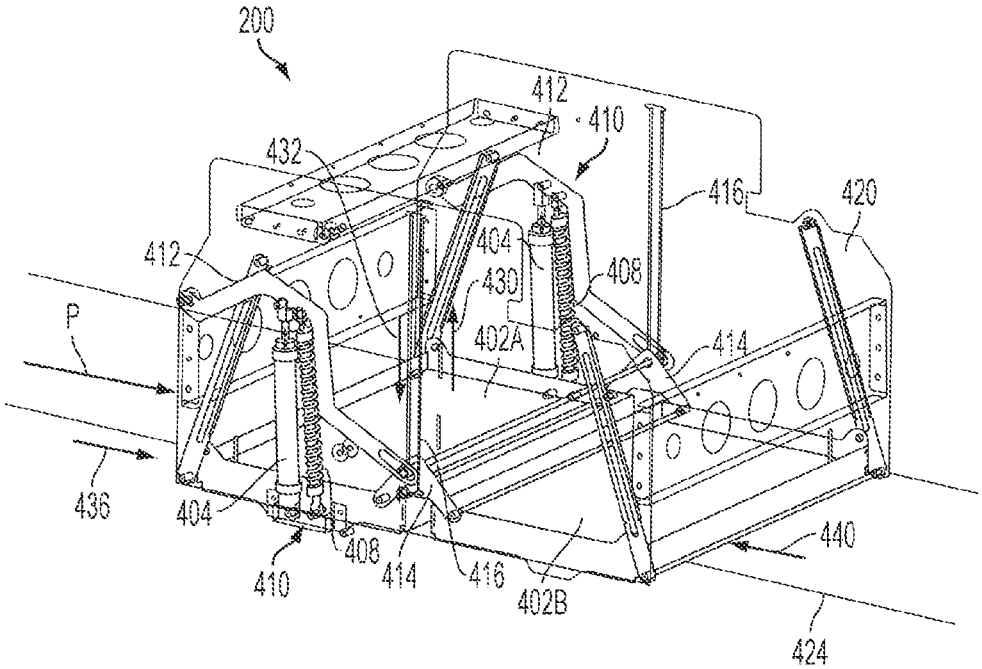
FIG. 5 is drawing of a radiant heating unit including two heater panels in a deployed configuration.
Figure 6:
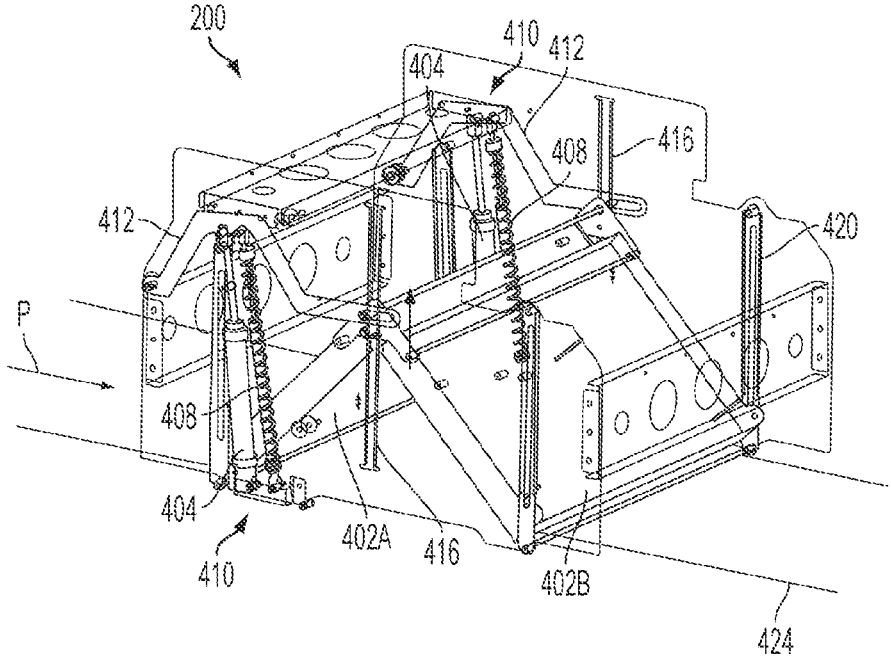
FIG. 6 is a drawing of the radiant heating unit of FIG. 5 with the two panels in an intermediate configuration.
Figure 7:
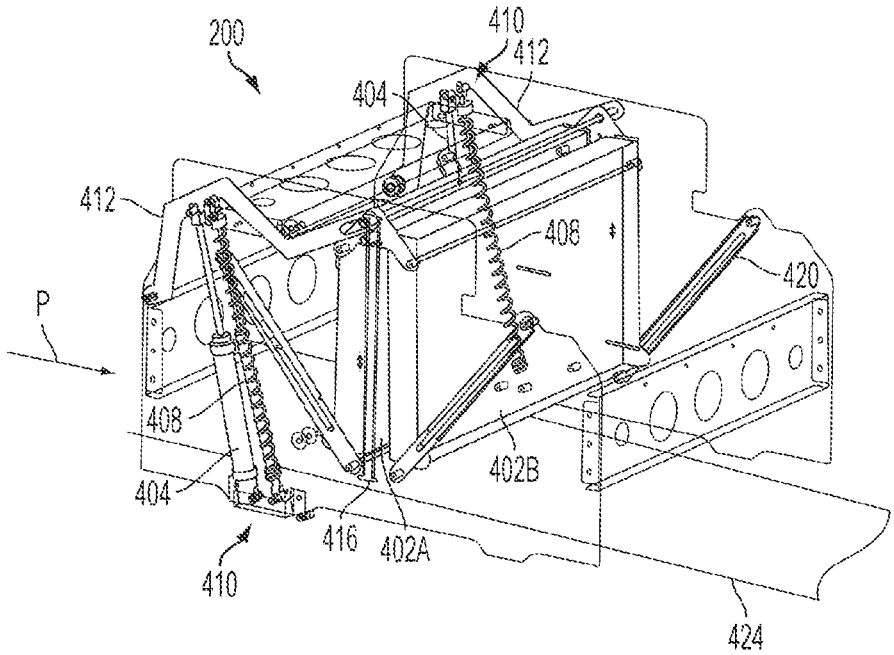
FIG. 7 is a drawing of the radiant heating unit of FIG. 5 with the two panels in a retracted configuration.

FIG. 5-FIG. 7 depict a radiant heating unit 200 with heater panels 402A and 402B arranged in three different positions. Radiant heating unit 200 includes two radiant heaters 402A and 402B, a panel driver 410, shown here as actuators 404 and gas springs 408, a drive link 412, drive path 416, and rotatable arms 420. A print medium, shown here as a continuous media web 424, travels in a process direction P past the radiant heating unit 200. The embodiment of radiant heater 204 from FIG. 2 may be used for the radiant heaters 402A and 402B, with the heating zones configured to deliver heat to the side edges of the media web 424 being arranged parallel to the process direction P. Drive link 412 includes two arms that are each rotatably engaged to actuator 404 and gas spring 408 at a first end and to a slidable member 414 at a second end. The slidable members 414 engage heaters 402A and 402B, and are configured to move along the drive path 416 in directions 432 and 430. Actuators 404 may be pneumatic, hydraulic, or electromechanical devices configured to move the drive link 412 and slidable members 414 along the drive path 416 in direction 430. Gas springs 408 are configured to generate a compressing force that urges the drive link 412 along the drive path 416 in direction 432. Thus, actuators 404 and gas springs 408 apply opposing forces to the drive link 412, and panel driver 410 may operate the actuators 404 and gas springs 408 to move heaters 402A and 402B to various positions with respect to the continuous media web 424. In the configuration of FIG. 5, radiant heaters 402A and 402B are arranged in parallel to the continuous media web 424. This configuration produces the maximum view factor for the heater unit 200 with substantially all of the radiant energy emitted from the radiant heaters 402A and 402B being directed towards continuous media web 424.

In operation, heating unit 200 receives variable radiant power signals and variable view factor signals from a controller, such as heater controller 110 described above. The variable view factor signal may be an electrical signal that directs actuators 404 to exert a predetermined amount of force in direction 430. The predetermined amount of force counteracts the forces exerted by gas springs 408 in direction 432. In the configuration of FIG. 5, the variable view factor signal may direct the actuators 404 to exert no force. In the configuration of FIG. 6, actuators 404 exert a force sufficient to raise drive links 412 to an intermediate position along drive path 416. The slidable member 414 pulls one end of each radiant heater 402A and 402B to the intermediate position. In response to the movement of slidable member 414, the opposite ends of heaters 402A and 402B move with rotatable arms 420 in directions 436 and 440, respectively.

As seen in FIG. 6, radiant heaters 402A and 402B are positioned at an acute angle with respect to the continuous media web 424. This angle directs a fraction of the radiant energy emitted towards the media web 424 in the configuration of FIG. 5 away from the media web. This action reduces the view factor presented by the heating unit. In FIG. 7, the controller operates the actuators to retract the radiant heaters 402A and 402B to a position that is substantially perpendicular with respect to continuous media web 424. In the retracted position the view factor cancels each panels radiant energy allowing the delivered power to be reduced to simmer at roughly 15 to 25% of the actual run power controlled by the thermocouple imbedded in the panel. The simmer power establishes the correct panel temperature prior to unfolding to reduce the time necessary to achieve the correct surface temperature for running. The panel duty cycle is controlled from the IR sensor on the paper during run. The panel device moves to retracted or closed position fast enough to prevent the web from achieving 300C surface temperature when the web is not moving. Additionally, the rotatable arms 420 enable radiant heaters 402A and 402B to slide together in directions 436 and 440, respectively.

In the configuration of FIG. 7, a minimal amount of radiant energy reaches the continuous media web 424 as the heater panels 402A and 402B shield most of the emitted radiant energy to establish a minimal view factor with respect to the continuous media web 424. The controller uses the variable view factor signal to operate the actuator 404 in the panel driver 410 to position the radiant heater panels 402A and 402B at various intermediate positions between the configurations of FIG. 5 and FIG. 7. Panel driver 410 is configured to move heater panels between any of the configurations shown in FIG. 5-FIG. 7, as well as to various intermediate positions.

The embodiment of heater unit 200 depicted in FIG. 5-FIG. 7 is illustrative of only one heater unit configuration. Various alternative embodiments may use a single heater panel, or use three or more heater panels in various configurations. Some embodiments may use heaters having different surface areas, heating zones, power outputs, and power densities in a single heater unit. The view factor may be also be adjusted in different ways. In one alternative embodiment, the view factor may be adjusted by moving the heaters in a linear direction to position the panels closer or farther from the media web. In another embodiment, a shielding member may be selectively positioned between a portion of the heaters and the media web to block a portion of the radiant energy from reaching the media web. Alternative mechanical drive units and drive link arrangements known to the art may be used to adjust the positions of the heaters.

It will be appreciated that variants of the above-disclosed and other features and functions, or alternatives thereof, may be desirably combined into many other different systems, applications or methods. For example, while the heater panels and radiant heater units depicted above are shown in the context of an inkjet printer, the foregoing heaters are suitable for heating print media to various operating temperatures in various embodiments of printers other than inkjet printers. Various presently unforeseen or unanticipated alternatives, modifications, variations or improvements may be subsequently made by those skilled in the art that are also intended to be encompassed by the following claims.

What is claimed:

1. A radiant heater for heating media in a printer comprising:

a ceramic foam substrate having a first edge and a second edge;

an electrical conductor bonded to the ceramic foam substrate; and a cover layer bonded to the electrical conductor, the electrical conductor having a first electrical resistance in a first heating zone formed proximate the first edge and the second edge of the ceramic foam substrate and a second electrical resistance in a second heating zone between the first edge and the second edge to enable radiant energy at a first power density in the first heating zone and radiant energy at a second power density in the second heating zone to be emitted by the cover layer, the first power density being greater than the second power density.

2. The radiant heater of claim 1 wherein the electrical conductor has a third electrical resistance in a third heating zone between the first heating zone and the second heating zone to enable radiant energy at a third power density to be emitted by the cover layer in the third heating zone.

3. The radiant heater of claim 1 wherein the cover layer in the first heating zone, the second heating zone, and the third heating zone is configured to emit radiant energy having wavelengths of greater than 3 μm.

4. The radiant heater of claim 1 further comprising:

a temperature sensor configured to generate a temperature measurement of at least one of the first heating zone, second heating zone, and third heating zone.

5. The radiant heater of claim 4 wherein the temperature sensor is a thermocouple positioned in the ceramic foam substrate.

6. The radiant heater of claim 4, the cover layer further comprising:

a fiberglass mesh; and an epoxy material between the electrical conductor and the fiberglass mesh to bond the fiberglass mesh to the electrical conductor and to form a fiberglass-epoxy matrix that emits the radiant energy generated by the electrical conductor.

7. A solid ink printer comprising:

a media handling system configured to transport a continuous media web along a media pathway through the imaging device, the media pathway having a first edge and a second edge;

a solid ink printing system positioned along the media pathway, the solid ink printing system being configured to print images on the continuous media web moving along the media pathway;

a web heating system positioned along the media pathway at a location that enables the web heating system to heat the continuous media web after the solid ink printing system has printed an image on the continuous media web, the web heating system being configured to heat the continuous media web to a web heating temperature, the web heating system comprising:

at least one radiant heating unit positioned adjacent the media pathway, the at least one radiant heating unit including:

a housing adjacent to the media pathway, the housing having an opening proximate the media pathway;

a pair of radiant heaters configured within the housing to emit radiant energy in accordance with a variable radiant power signal, the pair of radiant heaters being configured to be positioned selectively in the housing to any one of a plurality of positions between and including a fully open position in which the pair of radiant heaters are positioned side by side in the opening of the housing to direct radiant energy towards the media pathway and a retracted position in which the pair of radiant heaters are positioned inside the housing and facing each other, a view factor of the pair of radiant heaters with respect to the media pathway being different for each position in the plurality of positions, each radiant heater comprising:

an electrical conductor bonded to a substrate, the electrical conductor forming a plurality of heating zones, at least one heating zone is configured to emit radiant energy at a first power density towards the first edge and the second edge of the media pathway, and at least one other heating zone configured to emit radiant energy at a second power density towards a central portion of the media pathway;

a panel driver operatively connected to the pair of radiant heaters to enable the pair of radiant heaters to be positioned in at least one of the plurality of positions in response to a variable view factor signal;

at least one temperature sensor configured to detect a temperature of the continuous media web moving along the media pathway and to generate a temperature signal indicative of the detected temperature of the continuous media web; and a web heating controller operatively connected to the panel driver and configured to generate a selected radiant power signal and the variable view factor signal for operation of the panel driver to position at least one radiant heater to heat the continuous media web to the web heating temperature, the web heating controller being configured to generate at least one of the radiant power signal signals and the variable view factor signals in accordance with the temperature signal generated by the at least one temperature sensor.

8. The printer of claim 7, the at least one temperature sensor further comprising:

a first temperature sensor configured to detect a temperature of the continuous media web at a position prior to the continuous media web reaching the pair of radiant heaters and to generate a first temperature signal indicative of the detected temperature of the continuous media web before the continuous media web reaches the pair of radiant heaters; and a second temperature sensor configured to detect a temperature of the media web at a position after the pair of radiant heaters have heated the continuous media web and to generate a second temperature signal indicative of the detected temperature of the continuous media web after the continuous media web passes the pair of radiant heaters.

9. The printer of claim 8, the web heating controller being configured to generate radiant power signal signals and variable view factor signals for at least one of the radiant heaters in accordance with the first and the second temperature signals.

10. The printer of claim 9, the web heating controller being configured to generate radiant power signals for the pair of the radiant heaters to operate the pair of radiant heaters to emit radiant energy to heat the continuous media web moving along the media pathway to the web heating temperature; and the web heating controller being configured to generate at least one variable view factor signal to adjust the view factor of the pair of radiant heaters to compensate for deviations of the detected temperature from the web heating temperature.

11. The printer of claim 7, wherein the first power density of radiant energy is greater than the second power density of radiant energy.

12. The printer of claim 7, wherein each heating zone emits radiant energy having wavelengths greater than 3 μm.

13. The printer of claim 7, the substrate further comprising:

a ceramic foam layer bonded to the electrical conductor;

an aluminum reflector positioned on a side of the ceramic foam layer opposite the electrical conductor; and a mineral wool layer positioned on the aluminum reflector.

14. The printer of claim 13, the radiant heater further comprising:

a cover layer bonded to the electrical conductor, the electrical conductor having a first electrical resistance in a first heating zone formed proximate a first edge and a second edge of the ceramic foam layer and a second electrical resistance in a second heating zone between the first edge and the second edge of the ceramic foam layer to enable radiant energy at the first power density in the first heating zone and radiant energy at a second power density in the second heating zone to be emitted by the cover layer, the first power density being greater than the second power density.

15. The printer of claim 14 wherein the electrical conductor has a third electrical resistance in a third heating zone between the first heating zone and the second heating zone to enable radiant energy at a third power density to be emitted by the cover layer in the third heating zone.

16. The printer of claim 15 wherein the cover layer in the first heating zone, the second heating zone, and the third heating zone is configured to emit radiant energy having wavelengths of greater than 3 μm.

17. The printer of claim 15 further comprising:

a temperature sensor configured to generate a temperature measurement of at least one of the first heating zone, second heating zone, and third heating zone.

18. The printer of claim 17 wherein the temperature sensor is a thermocouple positioned between the electrical conductor and the cover layer.

19. A radiant heater comprising:

an electrical conductor having a first electrical resistance; and a cover layer essentially comprised of a fiberglass-epoxy matrix, the cover layer being configured to emit heat generated by an electrical current flowing through the electrical conductor, the emitted heat having a wavelength in a predetermined range.

20. The radiant heater of claim 19 wherein the predetermined range corresponds to a range for infrared electromagnetic radiation.

* * * * *